US005350330A

United States Patent [19]

Platis

[11] Patent Number: 5,350,330

[45] Date of Patent: Sep. 27, 1994

[54] FLOATING MARKER FOR AN ANCHOR LINE

[76] Inventor: Gary W. Platis, 2082 Business Ctr. Dr. #225, Irvine, Calif. 92715

[21] Appl. No.: 78,743

[22] Filed: Jun. 16, 1993

[51] Int. Cl.[5] ..... B63C 9/08
[52] U.S. Cl. ..... 441/6; 43/43.14
[58] Field of Search ..... 441/6, 13, 16, 17, 18, 441/23; 43/43.1, 43.14

[56] References Cited

U.S. PATENT DOCUMENTS

| | | | |
|---|---|---|---|
| 1,801,729 | 4/1931 | Elliott | 43/44.9 |
| 2,540,831 | 2/1951 | Pfleumer | 441/133 |
| 2,779,122 | 1/1957 | De Groff | 43/44.9 |
| 2,849,827 | 9/1958 | Gardiner | 43/43.14 |
| 3,161,982 | 12/1964 | Lee | 43/43.1 |
| 3,877,096 | 4/1975 | Scesney | 441/6 |
| 3,922,990 | 12/1975 | Menard, Jr. | 114/297 |
| 4,359,836 | 11/1982 | Yuji | 43/44.9 |
| 4,501,564 | 2/1985 | Cairone, Sr. | 441/20 |
| 4,601,126 | 7/1986 | Klocksiem | 441/6 |
| 4,936,804 | 6/1990 | Dowdeswell | 441/6 |

FOREIGN PATENT DOCUMENTS

| | | | |
|---|---|---|---|
| 176887 | 4/1986 | European Pat. Off. | 43/43.1 |

*Primary Examiner*—Jesus D. Sotelo
*Attorney, Agent, or Firm*—Macro-Search Corp.

[57] ABSTRACT

A floatation marker is provided for locating and identifying an anchor line. A float provides an interior surface formed as a frustum of a cone. The surface defines a central hole in the float. Preferably, the float provides for a sloped exterior surface so that, with the marker floating in water, the exterior surface is visible from an elevated position. Preferably the float is shaped as a modified torus. A passageway for the anchor line from outside of the float into the central hole of the float is provided so that the anchor line passes through the central hole. A passage block blocks the passage such that the anchor line cannot be passed back through the passage. The passage block may be a sleeve formed so as to fit loosely and slidably around the float so that in one position on the float the sleeve blocks the passage, while in another position on the float the sleeve does not block the passage. An enhanced visibility indicia of the floatation marker is positioned on the marker for enhanced night visibility.

5 Claims, 1 Drawing Sheet

FLOATING MARKER FOR AN ANCHOR LINE

FIELD OF THE INVENTION

This invention relates generally to buoys and, more particularly, is directed, towards a floatation buoy for indicating the position of an anchor line on a water surface.

BACKGROUND OF THE INVENTION

Much damage can be done to water vessels upon collision with other objects that are floating or are otherwise supported in the water. This danger is particularly acute at night, when the probability of seeing the objects in time to avoid a collision is almost zero. Further, many such objects are small to begin with, further reducing the chance of seeing them from an approaching vessel. Fishing nets and anchor lines are examples of such objects. Colliding with these objects almost certainly damages them and often damages the hull or motor of the vessel.

U.S. Pat. No. 4,501,564 to Cairone, Sr., on Feb. 26, 1985, teaches a luminescent foam float particularly well suited for floating fishing nets. A luminescent pigment is included both on the surface of the float and within the float, such that one who is approaching the float in a vessel may visually observe the float, or perhaps observe a large ring of such floats located on the periphery of a fishing net, and thereby steer to avoid colliding with the net. Such a device, while well suited for fishing nets, does not make suitable provision for accepting a ship's anchor line and actively signaling the entry location of such into the water. Further, in prolonged darkness, luminescent pigments become de-energized and, as they no longer luminesce, they can no longer be seen. Floats of this type, therefore, have limited use.

Other floatation buoys and collars exist, such as those found in U.S. Pat. No. 2,540,831 to Pfleumer on Feb. 6, 1951, and in U.S. Pat. No. 4,936,804 to Dowdeswell on Jun. 26, 1990. Such devices all have considerable drawbacks if they are used to indicate the location of anchor lines. For example, such devices make no provision for allowing an anchor line to be removably engaged therewith while in use, and later removed if desired, without removing the anchor from the end of the anchor line. Such devices, further, make no provision for improved visibility in adverse or darkened conditions.

U.S. Pat. No. 4,359,836, issued to Yuji on Nov. 23, 1982, teaches a fishing float for accepting a fishing line. Provision is made to illuminate the float with a small lamp. However, such a device is ill-suited for the stresses encountered with an anchor line, and has the same drawbacks associated with the aforementioned luminescent float device.

Clearly, then, there is a need for a floatation marker for marking the entry location of an anchor line into the water. Such a needed device would allow relatively quick installation and removal onto and off of the anchor line, even if an anchor attached to the line has already been dropped. Further, such a needed device would actively indicate its position at night, such as with a light source. The present invention fulfills these needs and provides further related advantages.

SUMMARY OF THE INVENTION

The present invention is a floatation marker for locating and identifying an anchor line. A float provides an interior surface formed as a frustum of a cone. The surface defines a central hole in the float. Preferably, the float provides for a sloped exterior surface, so that with the marker floating in the water, the exterior surface is visible from an elevated position such as from on the deck of a nearby vessel. Preferably the float is shaped as a modified torus. A passage for the anchor line from outside of the float into a central hole is provided such that the anchor line may pass through the central hole. A blocking means blocks the passage such that the anchor line cannot be passed back through the passage means. The passage means may be a gap in the float, the gap being of sufficient width to allow the anchor line to pass therethrough. The blocking means is a sleeve formed so as to fit loosely and slidably around the float so that in one position on the float the sleeve blocks the gap, while in another position on the float the sleeve does not block the gap. An enhanced visibility means of the floatation marker for enhanced night visibility is positioned on the marker so that the visibility means can be seen from a distance.

The present invention marks the exact entry location of an anchor line into the water. The present device may be quickly installed and removed onto and off of the anchor line, even if the line has already been lowered into the water. Further, the present device actively signals its position at night with a light source. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
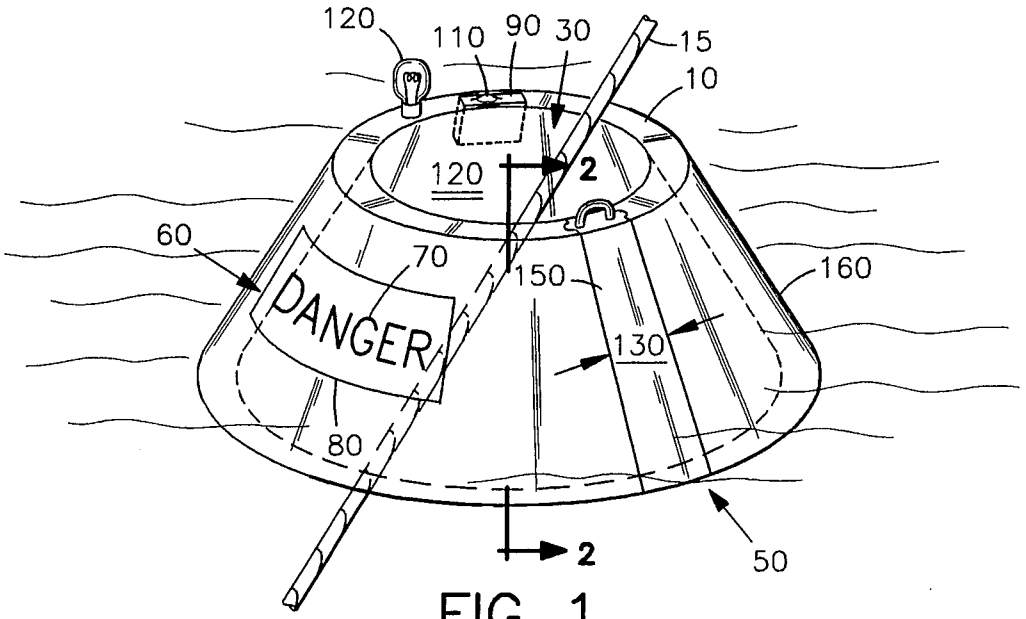
FIG. 1 is a perspective view of the invention, illustrating a modified torus floatation means floating in water with an anchor line passing through a central hole thereof.
Figure 2:
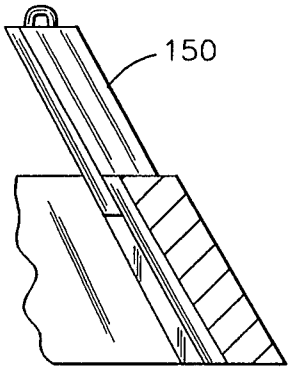
FIG. 2 is a cross-sectional view of the invention, taken generally along lines 2—2 of FIG. 1, and illustrating a passage means and a blocking means of the invention.
Figure 3:
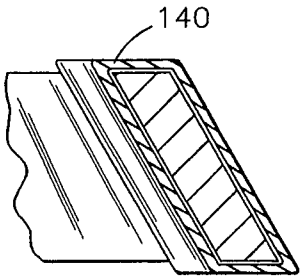
FIG. 3 is a cross-sectional view of the invention, taken generally along lines 2—2 of FIG. 1, illustrating an embodiment of the invention with a blocking sleeve.
Figure 4:
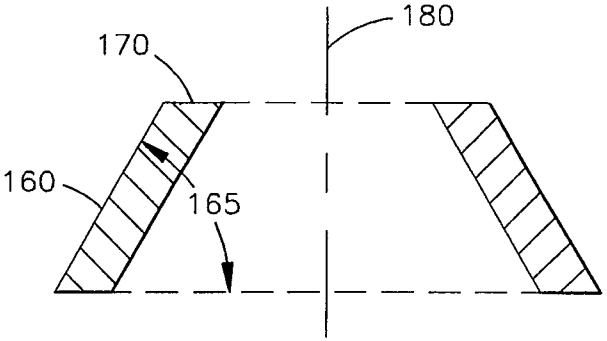
FIG. 4 is a cross-sectional view of the invention, taken generally along lines 4—4 of FIG. 1, illustrating a modified quadrilateral polygon rotated around a line.

FIG. 1 shows a floatation marker for locating and identifying an anchor line 15, such anchor line 15 typically being a cable, a rope, or a chain. The line is typically deployed off the bow of a ship into the body of water in which the vessel floats. The floatation marker is not attached to the anchor line, but is captured by the line so as to remain with the line and to mark its entry into the water although the body of water may not be calm. A floatation means 10 provides an interior surface 20 formed as a frustum of an inverted cone. The surface 20 defines a central hole 30 in the floatation means 10. Preferably, the floatation means 10 provides for a sloped exterior surface 160, the slope angle being between 70 and 80 degrees (FIG. 4), so that with the marker floating in water, the exterior surface 160 is visible from an elevated position such as from on the deck of a nearby vessel (not shown). Preferably the floatation means 10 is shaped as a modified torus (FIG. 1) with a surface of revolution generated by rotating a modified quadrilateral polygon 170 through 360 degrees in space about a line 180 in the plane of the modified quadrilateral polygon 170, the line 180 not passing through the modified quadrilateral polygon 170 (FIG. 4). As such, the interior surface defines a central hole in the flotation means, and presents a surface having an angle of approximately 70 to 80 degrees with the surface of the body of water. Therefore, at least one portion of the interior surface is always approximately parallel with the anchor line. This is advantageous in that the marker receives less wear from the line as these two elements contact each other during relative movement. The floatation means 10 may be made from any suitable buoyant material, such as plastic, rubber, foam rubber, and the like. Such material is flexible and resilient, yet strong enough not to be damaged from contacting the anchor line 15 as the anchor line 15 passes through the central hole 30. The floatation means 10 may include rounded top edges (not shown) so that the anchor line 15 will not tend to snag the floatation means 10 as the anchor line 15 passes through the surface of the is water. This is particularly desirable when the anchor line 15 is a chain. Further, the floatation means 10 may be manufactured with a buoyant core and a strong, rigid shell (not shown). Such an embodiment might provide a highly buoyant foam core with a thin aluminum or hard plastic shell, for example.

A passage means 40 of the anchor line 15 from outside of the floatation means 10 into the central hole 30 is provided such that the anchor line 15 passes through the central hole 30. A blocking means 50 blocks the passage means 40 such that the anchor line 15 cannot be passed through the passage means 40. The passage means 40 may be a gap 130 in the floatation means 10, the gap 130 being of sufficient width to allow the anchor line 15 to pass therethrough. In such an embodiment, the blocking means 50 is a sleeve 140 formed so as to fit loosely and slidably around the floatation means 10 so that in one position on the floatation means 10 the sleeve 140 blocks the gap 130, while in another position on the floatation means 10 the sleeve 140 does not block the gap 130. Alternatively, the blocking means 50 may be a hatch type door 150 fitted for sliding engagement within the gap 130 so that the door 150 may be removed for passage of the anchor line 15 through the gap 130, after which the door 150 is slid back into place to block the gap 130.

Figure 5:
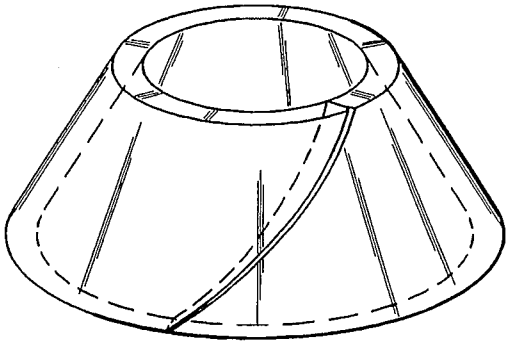
FIG. 5 is a perspective view of the invention, illustrating an embodiment wherein the passage and blocking means of the invention is a radial slit into the floatation means.

In an alternate, more simplified embodiment of the invention, the passage means 40 is a radial slit 45 in the floatation means 10 that is normally closed (FIG. 5). The slit 45 may be opened by pulling each side of the floatation means 10 apart, thereby forming the gap 130. Upon release, the gap 130 closes as the floatation means 10 assumes its normal shape. In such an embodiment, the floatation means 10 is formed to have its preferred shape with the slit 45 closed, the slit 45 being closed with such a force that the anchor line 15 will not, through normal forces experienced in the water, cause the slit 45 to open. The slit may be oriented at an angle to the anchor line such that the latter and former are not normally aligned when the marker is floating in the body of water with the anchor line passing through it. In this way, the line cannot force the slit open enough for the line to pass through it.

As illustrated in FIG. 1, an enhanced visibility means 60 of the floatation marker for enhanced night visibility is positioned on the marker so that the visibility means 60 can be seen from a distance. In one embodiment of the invention, the enhanced visibility means 60 is reflective paint 70, perhaps taking the form of a warning symbol or word. The enhanced visibility means 60 may further include a reflective sheet 80 that is adhered to the floatation means 10.

The enhanced visibility means 60 might further include a water-proof lighting circuit 90 comprising an electrical energy source 100, a switch 110 for making the circuit 90, and a light source 120, such as a lamp that is prominently displayed on the marker. Such a lighting circuit 90 might further include a means (not shown) for blinking the light source 120, in which case the light source 120 might be a low-energy high-intensity strobe light. The energy source 100 might be a conventional cell, or a recharging cell with solar panels (not shown) situated on the exterior surface 160 for recharging of the energy source 100. Further, the switch 110 may be of the type that makes the circuit 90 by detecting water on the bottom surface of the floatation means 10 so that the switch 110 only makes the circuit 90 when the floatation marker is deployed in the water. Still further, the switch 110 may be of the type that makes the circuit 90 by detecting darkness so that the switch 110 only makes the circuit 90 at night or during darkened conditions.

In operation, with the anchor (not shown) either raised or lowered, the blocking means 50 is removed from the floatation means 10 and the anchor is line 15 is passed through the passage means 40 such that the anchor line 15 is captured by the floatation means 10 with the anchor line 15 passing through the central hole 30. The blocking means 50 is then slid back into place, thereby preventing the anchor line 15 from escaping the floatation means 10. The anchor is then deployed, whereby the floatation means 10 keeps the floatation marker floating as the anchor drops and the anchor line 15 passes through the central hole 30 in the floatation means 10. In the case where the anchor had been previously deployed before installation of the floatation marker on the anchor line 15, the floatation marker is released to slide down the anchor line 15 until it contacts the water. As such, the floatation marker provides a means for ships to avoid the anchor line 15 during passage nearby.

While the invention has been described with reference to a preferred embodiment, it is to be dearly understood by those skilled in the art that the invention is not limited thereto. Rather, the scope of the invention is to be interpreted only in conjunction with the appended claims.

I claim:

1. A floating marker for floating on the surface of a body of water for identifying the location of an anchor line while not being attached to the anchor line, the marker comprising:

a flotation means shaped as a modified torus providing an interior surface formed as a frustrum of an inverted cone, the interior surface defining a central hole in the flotation means, and forming an angle with the surface of the body of water of between approximately 70 and 80 degrees such that at least one portion of the interior surface is approximately parallel to the anchor line;

a means for providing passage of the anchor line from outside the flotation means into the central hole, the flotation means thereby encircling the anchor line while being free to move on the surface of the body of water relative to the anchor line; and means for closing the passage means such that the anchor line cannot pass out therefrom, and further that the marker provides a visible indicator to mark the location of the anchor line, the latter being free to move within the central hole.

2. The marker of claim 1 wherein the marker is produced of a flexible and resilient material, the passage memos being a radial slit in the flotation means, the slit being normally closed so as to prevent the anchor line from passing therethrough, the slit being manually opened for passage of the anchor line.

3. The marker of claim 2 wherein the radial slit is oriented at an angle to the anchor line such that the latter and former are not normally aligned when the marker is floating in the body of water with the anchor line passing therethrough.

4. The marker of claim 1 wherein the flotation means provides for a sloped exterior surface, the slope angle being between 70 and 80 degrees so with the marker floating, the exterior surface is visible from an elevated position such as on the deck of a nearby vessel.

5. The marker of claim 1 wherein the modified torus is a surface of revolution generated by rotating a modified quadrilateral polygon through 360 degrees in space about a line in the plane of the modified quadrilateral polygon, said line not passing through the modified quadrilateral polygon.

* * * * *